US009869070B2

(12) United States Patent
Green et al.

(10) Patent No.: US 9,869,070 B2
(45) Date of Patent: Jan. 16, 2018

(54) SOIL REINFORCEMENT SYSTEM INCLUDING ANGLED SOIL REINFORCEMENT ELEMENTS TO RESIST SEISMIC SHEAR FORCES AND METHODS OF MAKING SAME

(71) Applicant: Geopier Foundation Company, Inc., Davidson, NC (US)

(72) Inventors: Russell Green, Christiansburg, VA (US); Kord J. Wissmann, Mooresville, NC (US)

(73) Assignee: GEOPIER FOUNDATION COMPANY, INC., Davidson, NC (US)

( * ) Notice: Subject to any disclaimer, the term of this patent is extended or adjusted under 35 U.S.C. 154(b) by 0 days.

(21) Appl. No.: 13/912,986

(22) Filed: Jun. 7, 2013

(65) Prior Publication Data

US 2014/0010600 A1 Jan. 9, 2014

Related U.S. Application Data

(60) Provisional application No. 61/656,687, filed on Jun. 7, 2012.

(51) Int. Cl.
*E02D 3/00* (2006.01)
*E02D 3/08* (2006.01)

(52) U.S. Cl.
CPC *E02D 3/00* (2013.01); *E02D 3/08* (2013.01)

(58) Field of Classification Search
USPC .... 405/232, 233, 256, 257, 245, 249, 302.4, 405/259.1, 288
See application file for complete search history.

(56) References Cited

U.S. PATENT DOCUMENTS

| | | | | |
|---|---|---|---|---|
| 4,707,956 A * | 11/1987 | Sato | E02D 5/38 52/167.4 |
| 6,425,713 B2 * | 7/2002 | Fox et al. | 405/243 |
| 6,719,498 B2 * | 4/2004 | Barley | 405/259.5 |
| 7,914,235 B1 * | 3/2011 | Brown | 405/229 |

FOREIGN PATENT DOCUMENTS

| | | | |
|---|---|---|---|
| JP | 02183009 | * | 7/1990 |
| JP | 11117276 | * | 4/1999 |
| JP | 11-247203 | A | 9/1999 |
| JP | 2000-199236 | A | 7/2000 |
| JP | 2000-282501 | A | 10/2000 |
| JP | 2001-32296 | * | 2/2001 |
| JP | 2004-300726 | A | 10/2004 |
| JP | 2006-299605 | A | 11/2006 |

OTHER PUBLICATIONS http://www.dictionary.com/browse/damping.*

* cited by examiner

*Primary Examiner* — Sean D Andrish
(74) *Attorney, Agent, or Firm* — Nexsen Pruet, PLLC; E. Eric Mills

(57) ABSTRACT

A soil reinforcement system including angled soil reinforcement elements to resist seismic shear forces and methods of making same are disclosed. For example, the soil reinforcement system includes an array or grid of angled soil reinforcement elements installed within the ground, wherein the angled reinforcement elements are designed to absorb and/or resist earthquake-induced seismic shear forces by transferring the applied shear forces into axial compressive and tensile forces within each of the angled reinforcement elements.

29 Claims, 19 Drawing Sheets

SOIL REINFORCEMENT SYSTEM INCLUDING ANGLED SOIL REINFORCEMENT ELEMENTS TO RESIST SEISMIC SHEAR FORCES AND METHODS OF MAKING SAME

CROSS REFERENCE TO RELATED APPLICATIONS

This application claims priority to and incorporates by reference U.S. Provisional Application Ser. No. 61/656,687 filed Jun. 7, 2012, entitled "Method and Apparatus for Creating Inclined Soil Reinforcement Elements to Resist Seismic Shear Forces," the disclosure of which is expressly incorporated by reference herein in its entirety.

TECHNICAL FIELD

The presently disclosed subject matter relates generally to mechanisms for resisting earthquake seismic shear stresses and forces and more particularly to a soil reinforcement system including angled soil reinforcement elements to resist seismic shear forces and methods of making same.

BACKGROUND

Earthquakes occur as a result of tectonic activity. When earthquakes occur they shake the bedrock in the vicinity of the fault rupture that results in shearing stresses applied to the soil column above the rock. Pore fluid is the groundwater held within a soil or rock; namely, in the gaps between particles (i.e., in the pores). Pore water pressure refers to the pressure of groundwater held within the pores of the soil or rock.

Seismically-induced shearing forces propagate upwards through the soil profile, often resulting in damage to existing structures and sometimes resulting in soil liquefaction. Liquefaction is a phenomenon that occurs in saturated soils that involves the transfer of the effective overburden load from the soil grains to the pore fluid, with the commensurate reduction in effective stress and, hence, reduction in soil strength. In earthquake-induced liquefaction, this transfer is initiated in sandy soils by the collapse of the soil skeleton due to earthquake shaking Following liquefaction, settlement occurs as the pore water pressures dissipate. Soil liquefaction can result in billions of dollars in structural damage and can lead to a loss of life.

Many methods are available to mitigate the effects of soil liquefaction or to render the soil non-liquefiable. Deep foundations (e.g., driven pilings, drilled concrete-filled shafts) can be used to bypass the liquefiable soil and reduce the effects of liquefaction. Dynamic compaction, vibroflotation, and the installation of stone columns are some methods used to densify clean granular soils and thereby reduce liquefaction potential. Vertical stiff inclusions have also been used to absorb seismic shear stresses to reduce liquefaction potential. However, this method is partially limited in its effectiveness because the elements, if sufficiently slender, inherently are more efficient at resisting shear forces through flexure (i.e., bending) in lieu of shear.

SUMMARY

In one aspect, the presently disclosed subject matter relates to a method of installing one or more angled soil reinforcement elements to resist seismic shear stresses. The method comprises inserting an angled stiff element into a soil matrix at a determined angle and to a determined depth. The one or more angled stiff elements preferably have a sufficient rigidity and area ratio such that seismic shear stresses imparted from seismic activity are transferred to the angled stiff element, thus reducing a potential for soil liquefaction. The one or more angled stiff elements may be inserted in the soil matrix by drilling means or by driving means. The one or more angled stiff elements comprise a material that exhibits a stiffness modulus greater than that of the soil matrix, which may comprise metallic material, non-metallic material, or a combination of metallic and non-metallic materials. In one embodiment, the one or more angled stiff elements are installed in an array.

The determined depth of the one or more angled stiff elements may be selected based on the in-situ liquefaction susceptibility of the matrix soil. The spacing and diameter of the one or more angled stiff elements may be determined such that the transfer of the seismic shear stresses to the elements is sufficient to reduce the shear strains in the soil to reduce the triggering of liquefaction. The angle of inclination may be a predetermined angle based on desired installation and load transfer efficiency criteria.

The one or more angled stiff elements may comprise cast-in-place shafts that are formed in the soil matrix. The shafts may be filled with concrete and/or grout. The one or more angled stiff elements may be installed using a mandrel driven or pushed into the ground and filled with the concrete and/or grout, and then the mandrel is extracted. The method may further comprise forming an angled drilled hole in the soil matrix and filling the angled hole with the concrete and/or grout. Reinforcing steel may also be added to the concrete and/or grout shafts prior to curing.

The one or more angled stiff elements may be installed in the soil matrix by piling equipment and may be driven or pushed into the soil matrix and may be filled with an in-fill after driving. The one or more angled stiff elements may be hollow and may be filled with an in-fill material after installation. In-fill material may comprise one or more of concrete, grout, gravel, aggregate, sand, recycled concrete, crushed glass, or other flowable or pumpable material. Further, the in-fill material may be compacted in place using a compaction device. In one embodiment, the one or more angled stiff elements may comprise a material with high permeabilities that facilitate drainage of excess pore water pressures during and after seismic events.

The one or more angled stiff elements may be installed on a grid pattern. The method may also further comprise a second grid pattern of one or more angled stiff elements angled 180 degrees from the first grid pattern of the one or more angled stiff elements. The method may also comprise a second grid pattern of one or more angled stiff elements installed in the transverse direction to that of the first grid pattern of the one or more angled stiff elements. The transverse direction of the second grid pattern may be either perpendicular to the first grid pattern or not perpendicular to the first grid pattern.

In another aspect, the presently disclosed subject matter relates to an angled stiff element for resisting seismic shear stresses. The angled stiff element has a sufficient rigidity and area ratio such that seismic shear stresses are transferred to the angled stiff element, thus reducing a potential for soil liquefaction. The angled stiff element may comprise a material that exhibits a stiffness modulus greater than that of a matrix soil in which it is installed.

In a further aspect, the presently disclosed subject matter relates to a system for installing one or more angled soil reinforcement elements to resist seismic shear stresses and forces. The system comprises: a) one or more angled soil reinforcement elements and b) a device for installing the one or more angled soil reinforcement elements into a soil matrix at a determined angle and to a determined depth. The device for installing the one or more angled soil reinforcement elements into the soil matrix may comprise a piling device for driving or pushing the one or more angled soil reinforcement elements into the soil matrix. The device for installing the one or more angled soil reinforcement elements into the soil matrix may also comprise a mandrel driven or pushed into the soil matrix, the mandrel is filled with grout and/or concrete, and then the mandrel is extracted. The device for installing the one or more angled soil reinforcement elements into the soil matrix may also comprise a drilling device. In one embodiment, the drilling device forms an angled drilled hole in the soil matrix and the hole is then filled with concrete and/or grout.

BRIEF DESCRIPTION OF THE DRAWINGS

Figure 1:
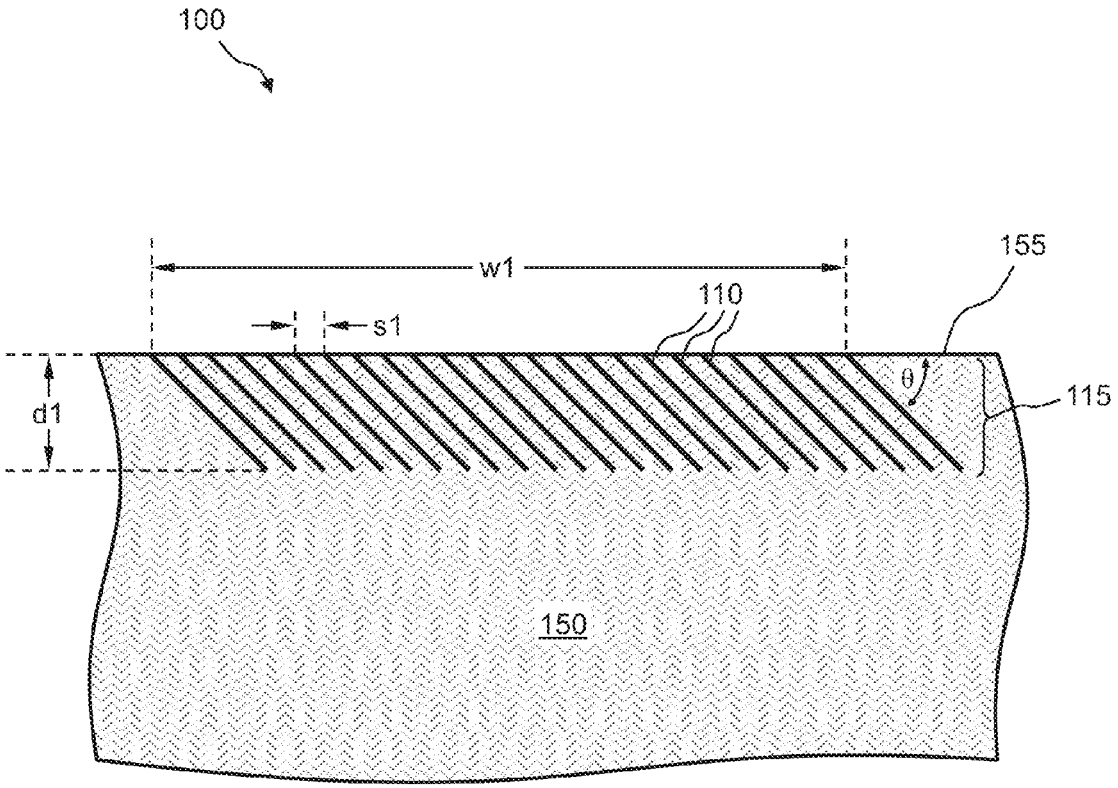
Figure 2:
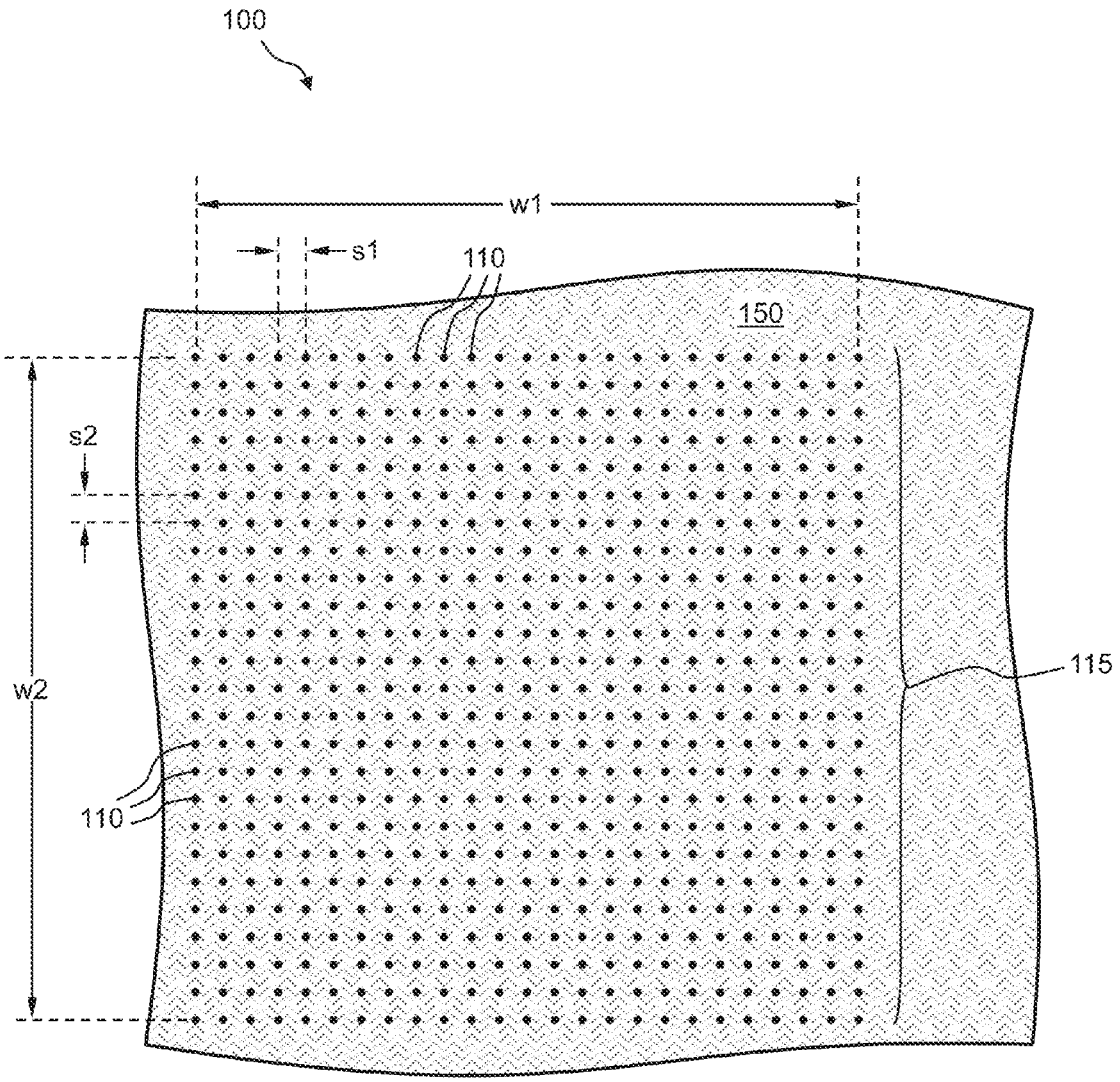
Figure 3:
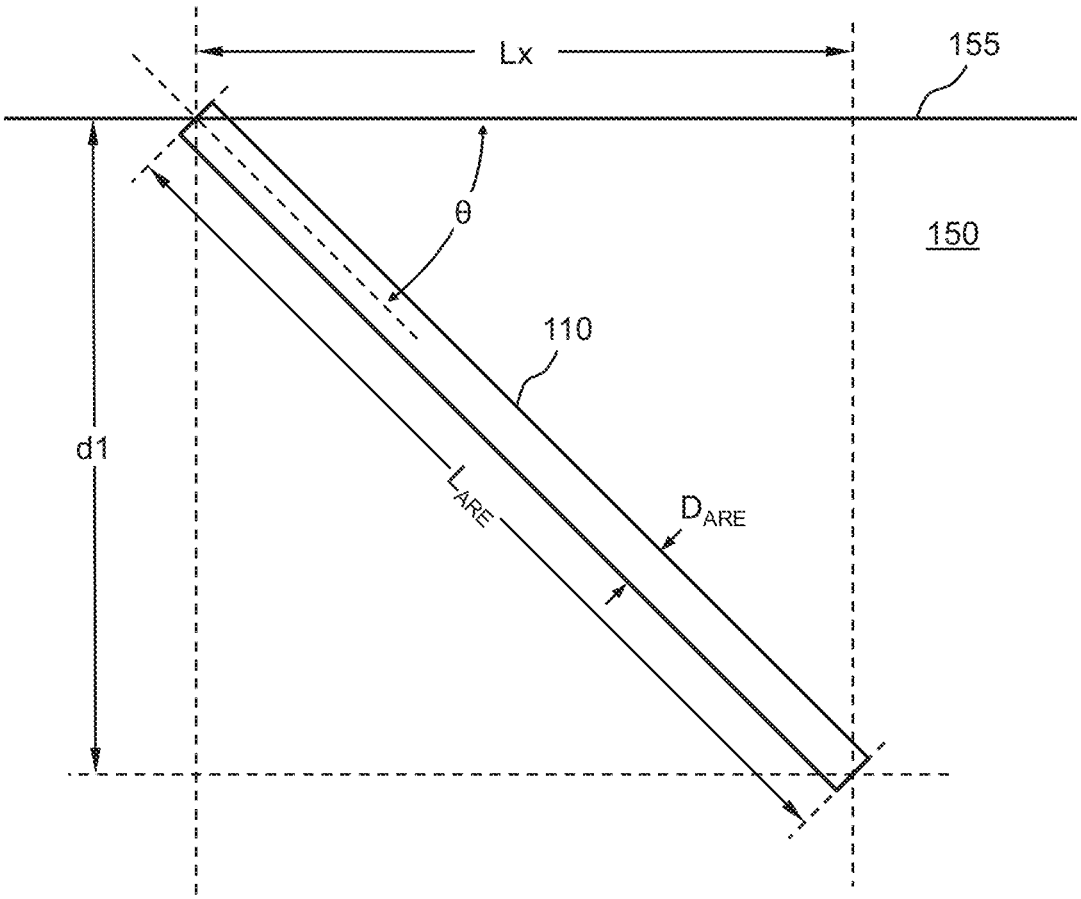
Figure 4:
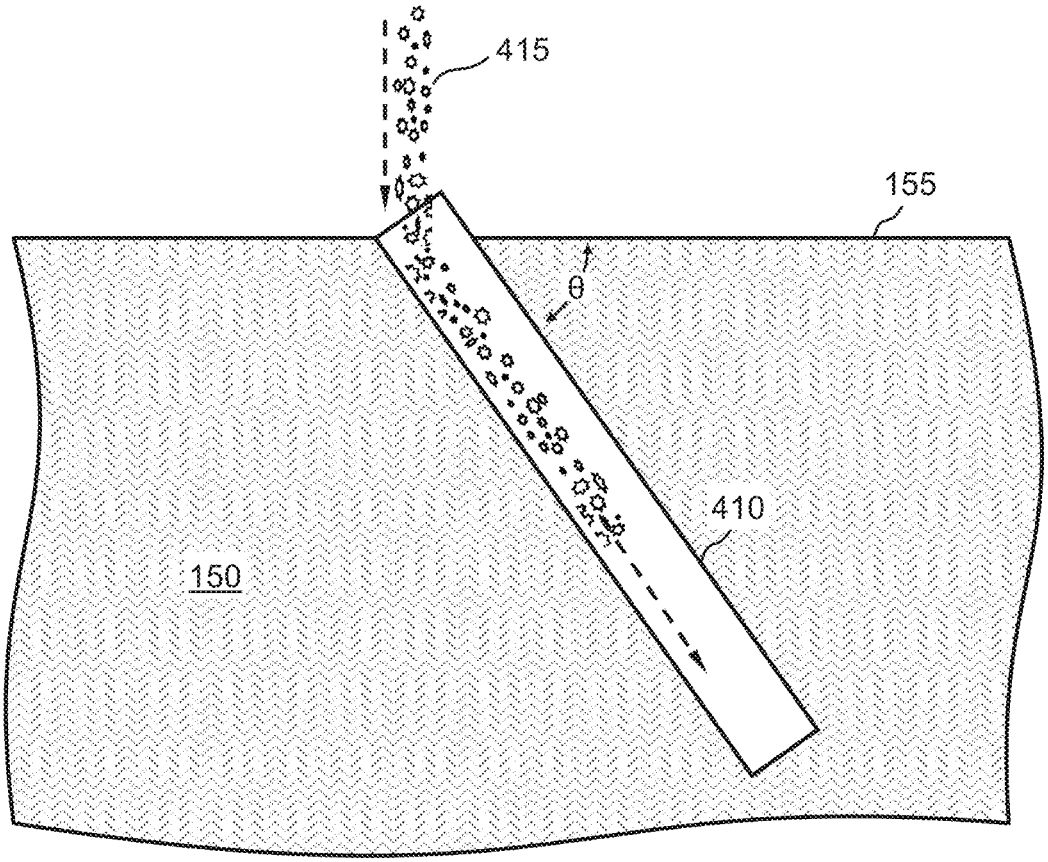
Figure 5:
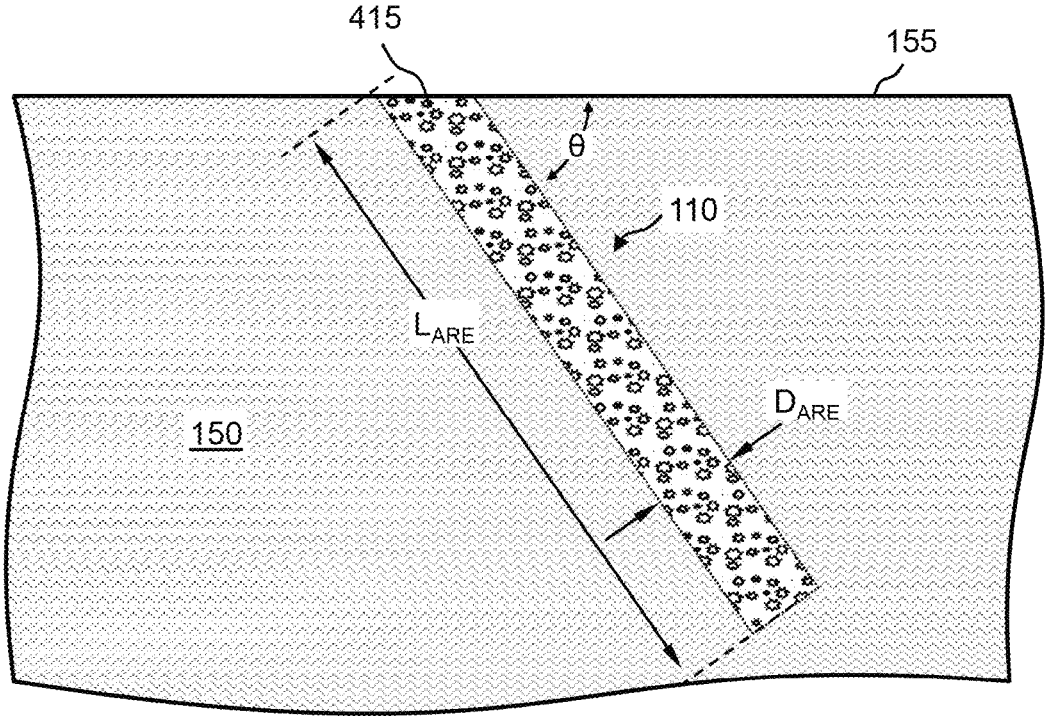
Figure 6:
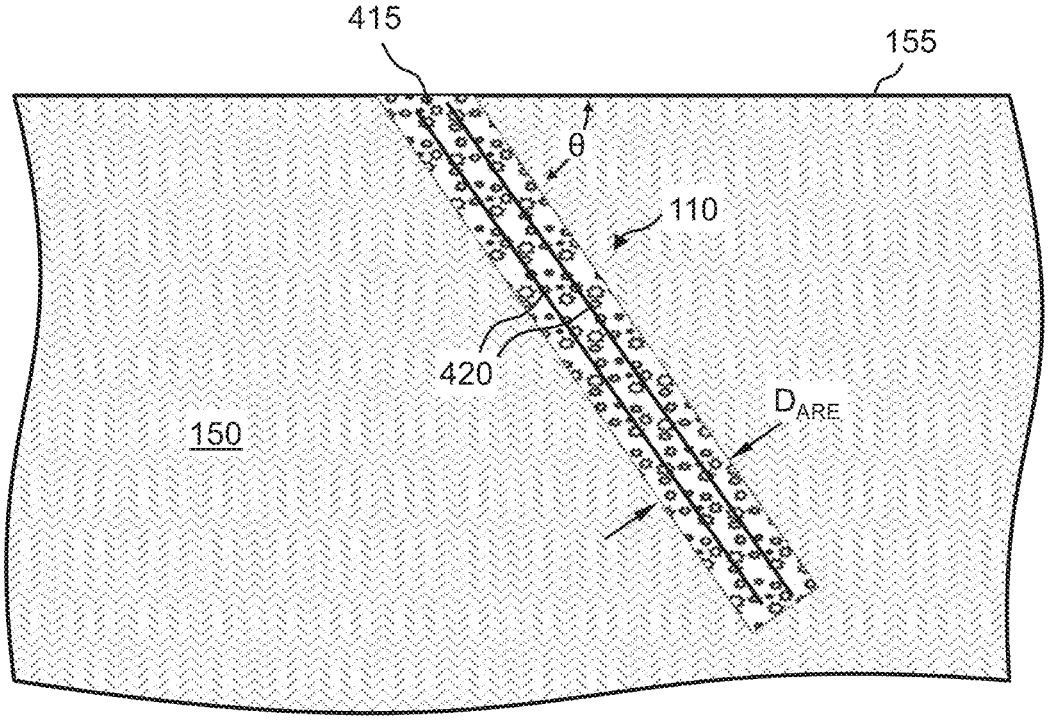
Figure 7:
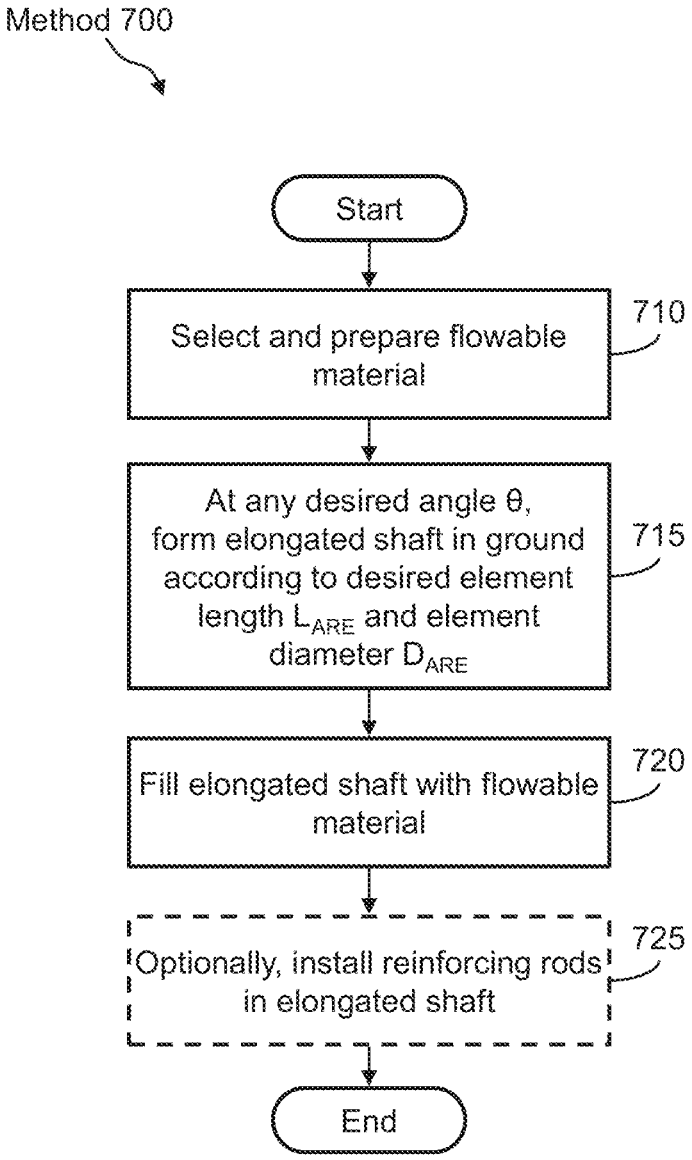
Figure 8:
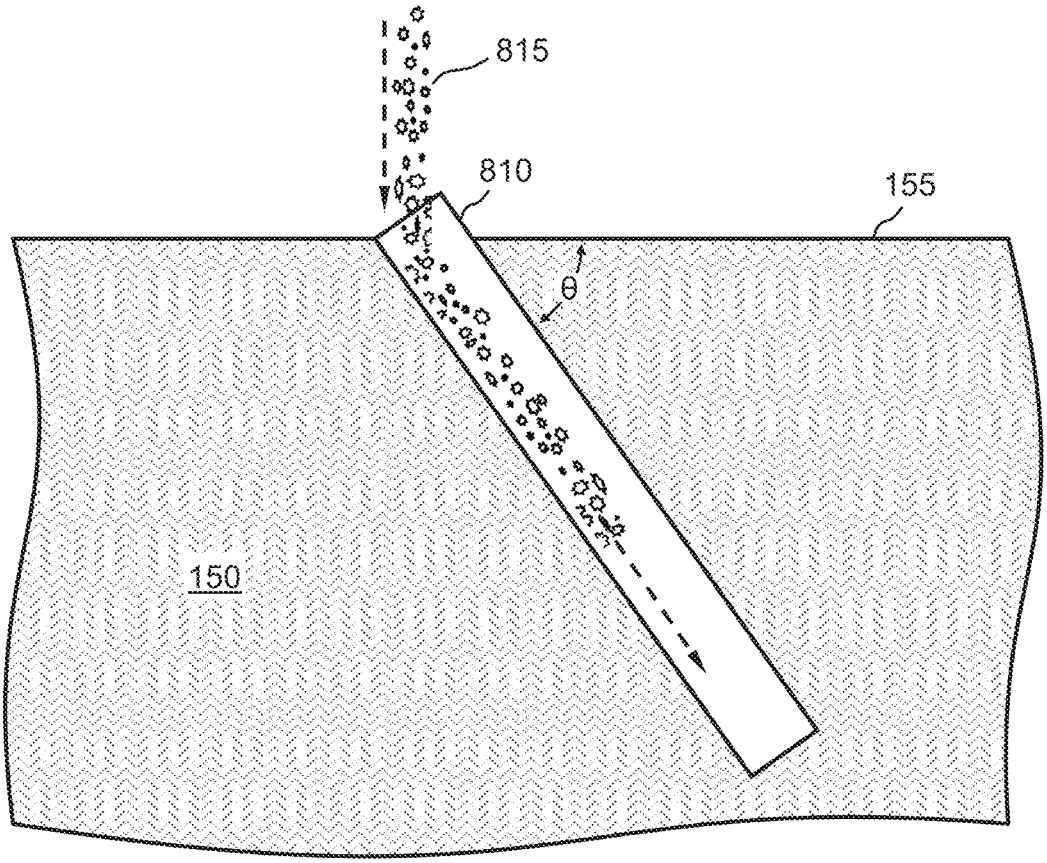
Figure 9:
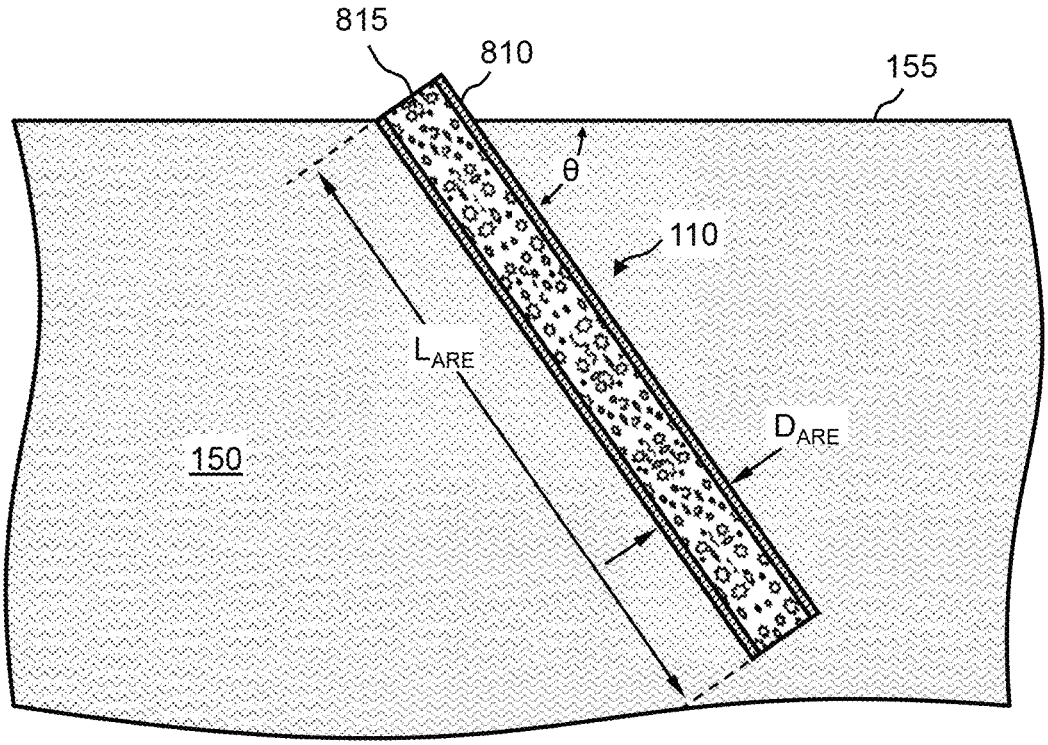
Figure 10:
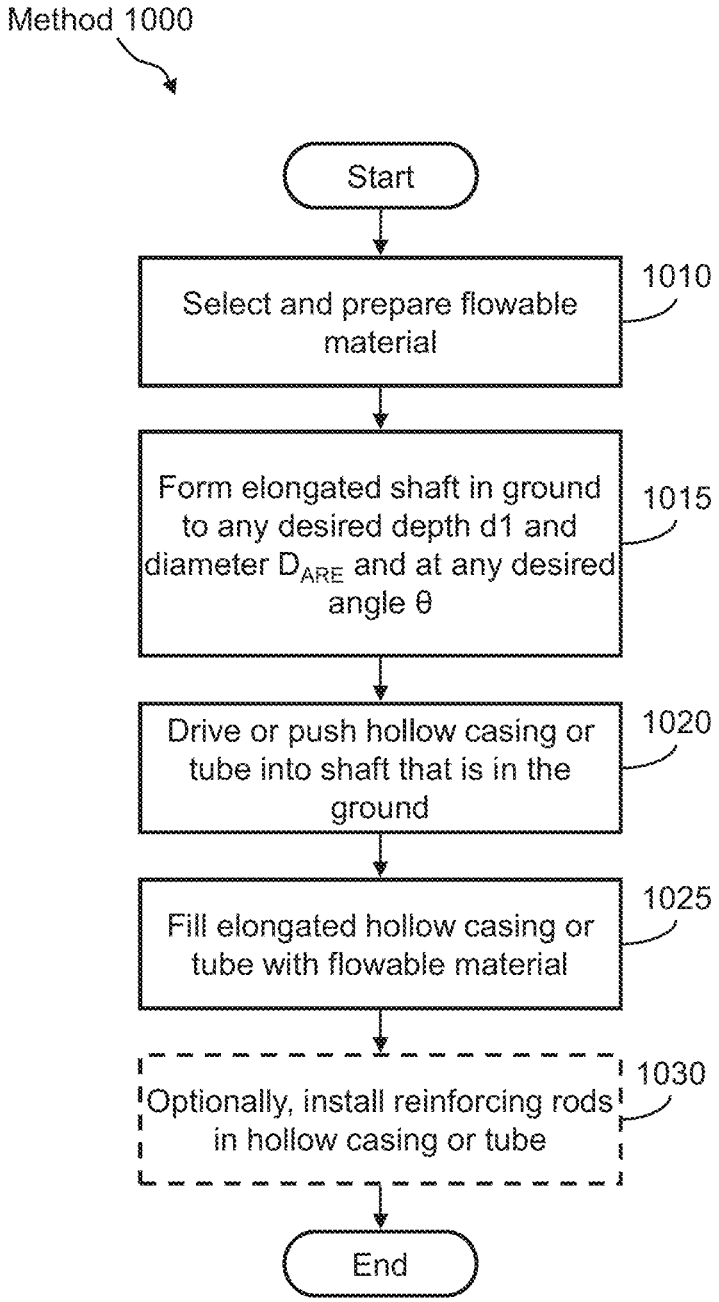
Figure 11:
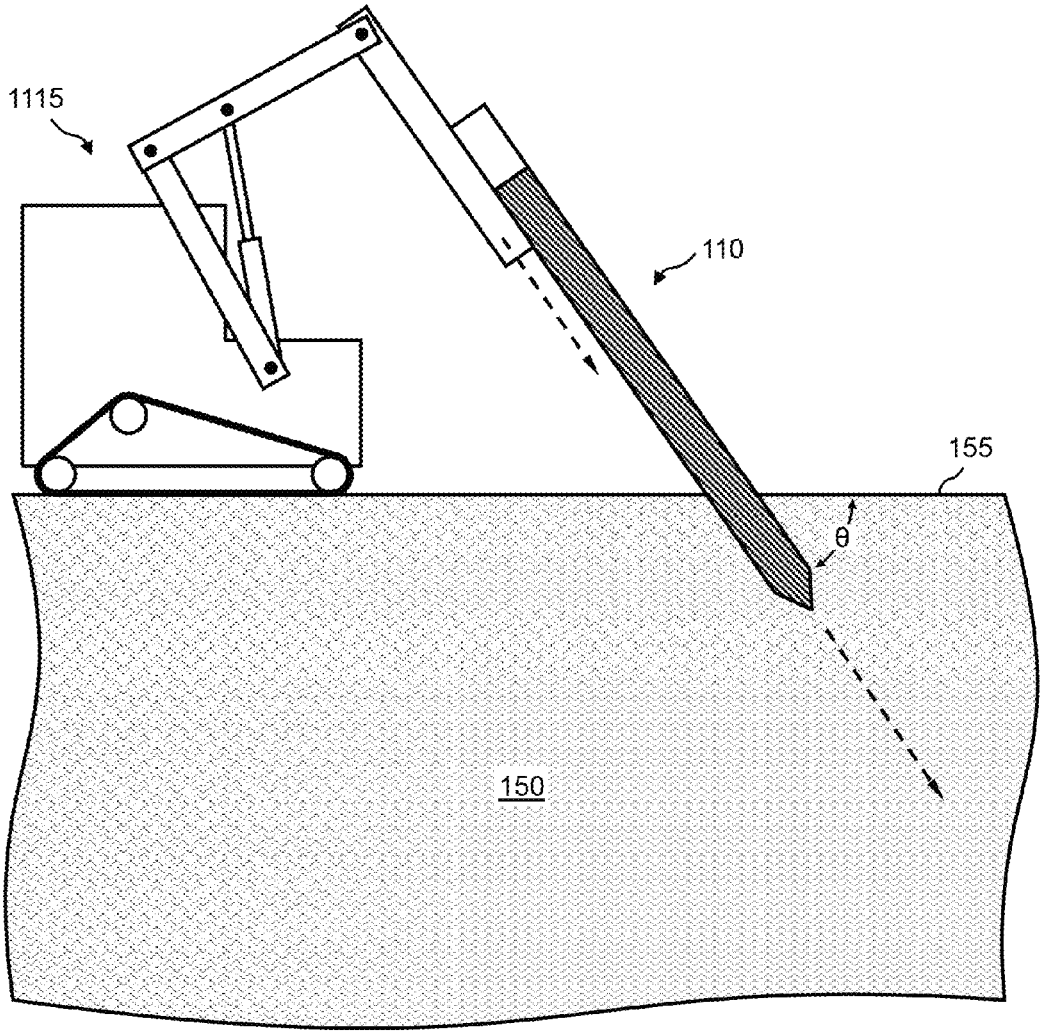
Figure 12:
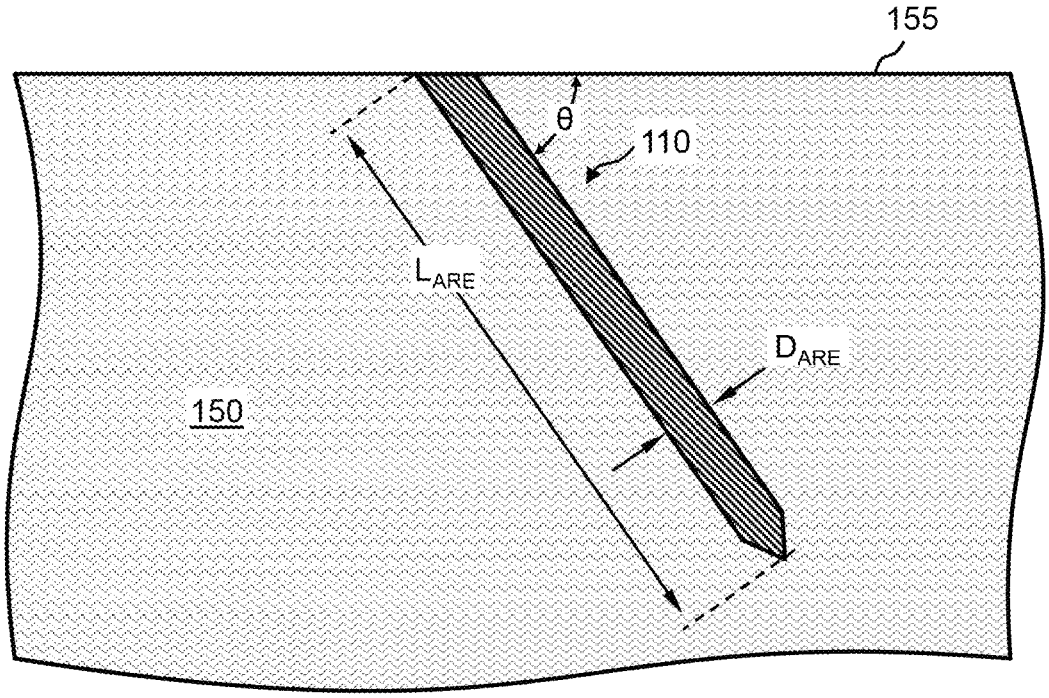
Figure 13:
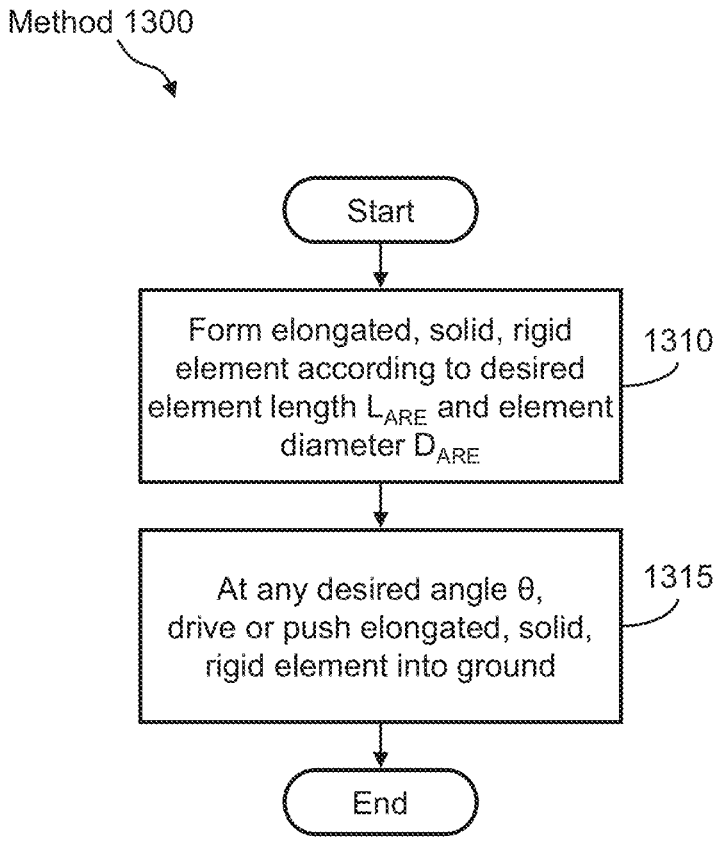
Figure 14:
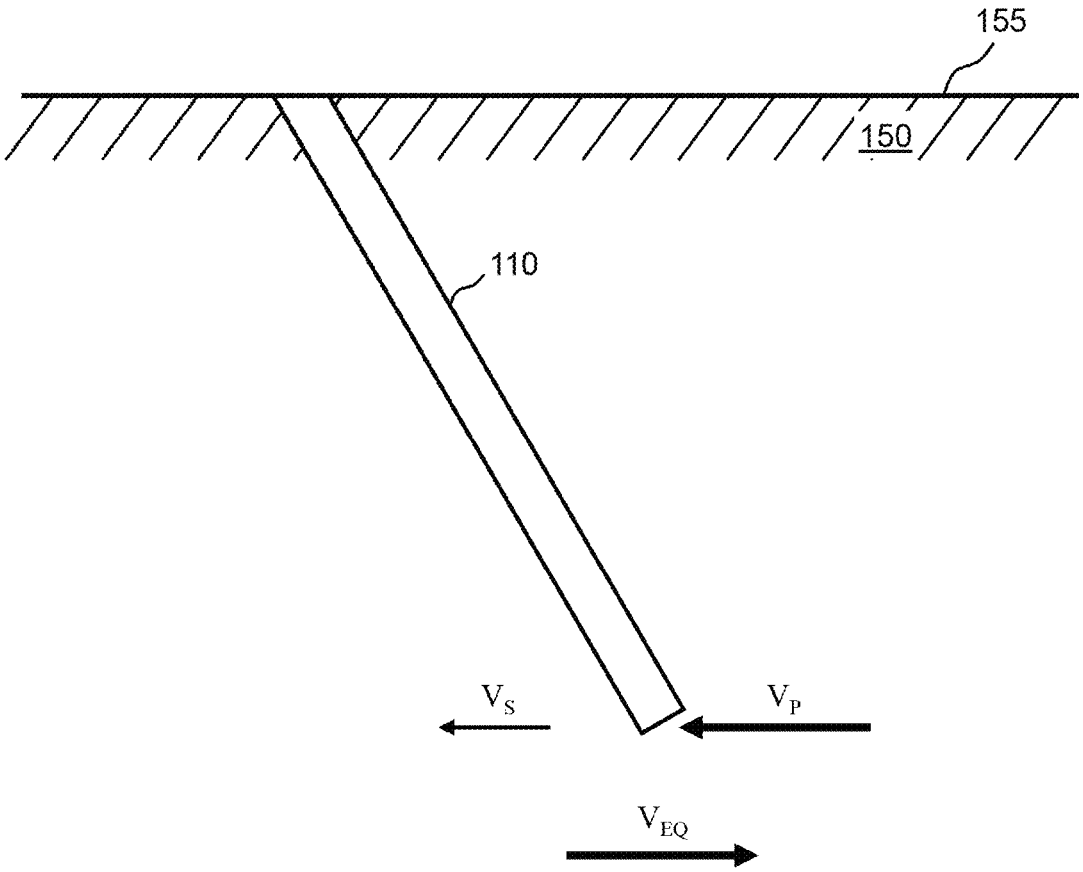
Figure 15:
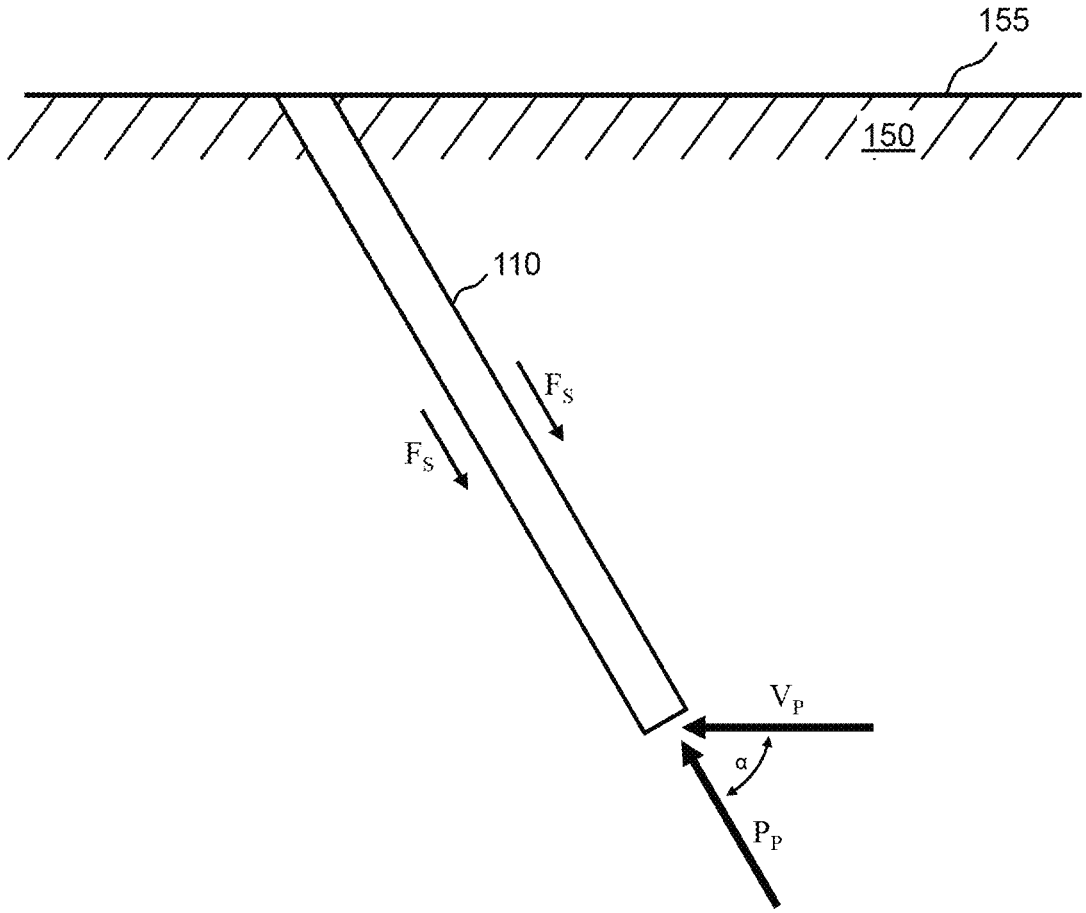
Figure 16:
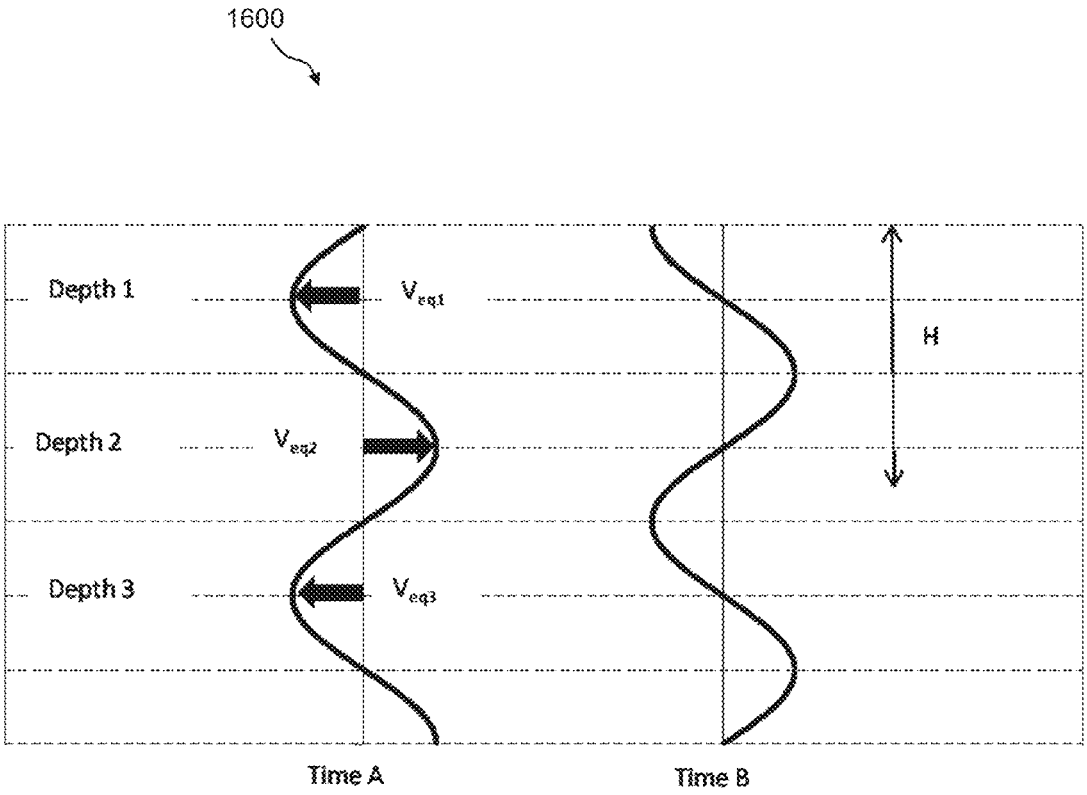
Figure 17:
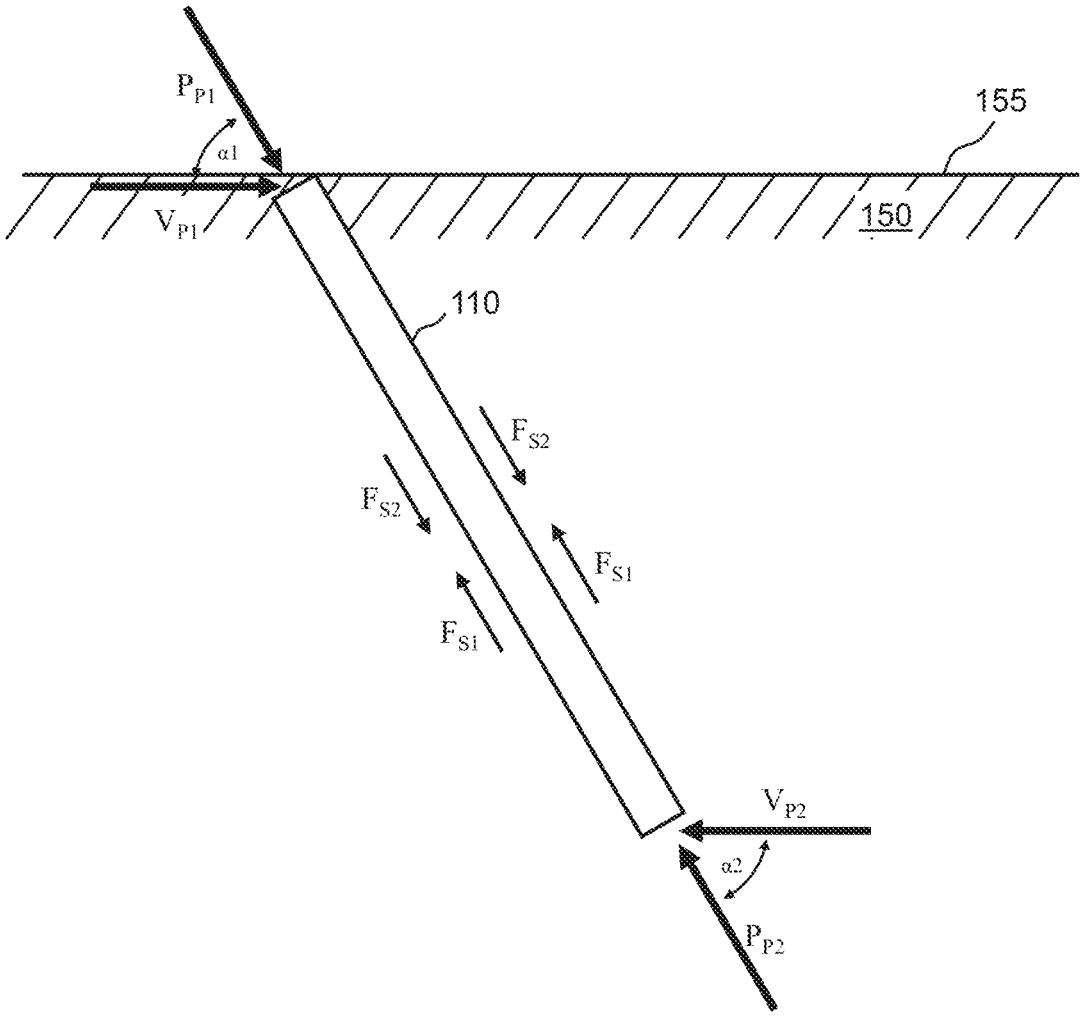
Figure 18:
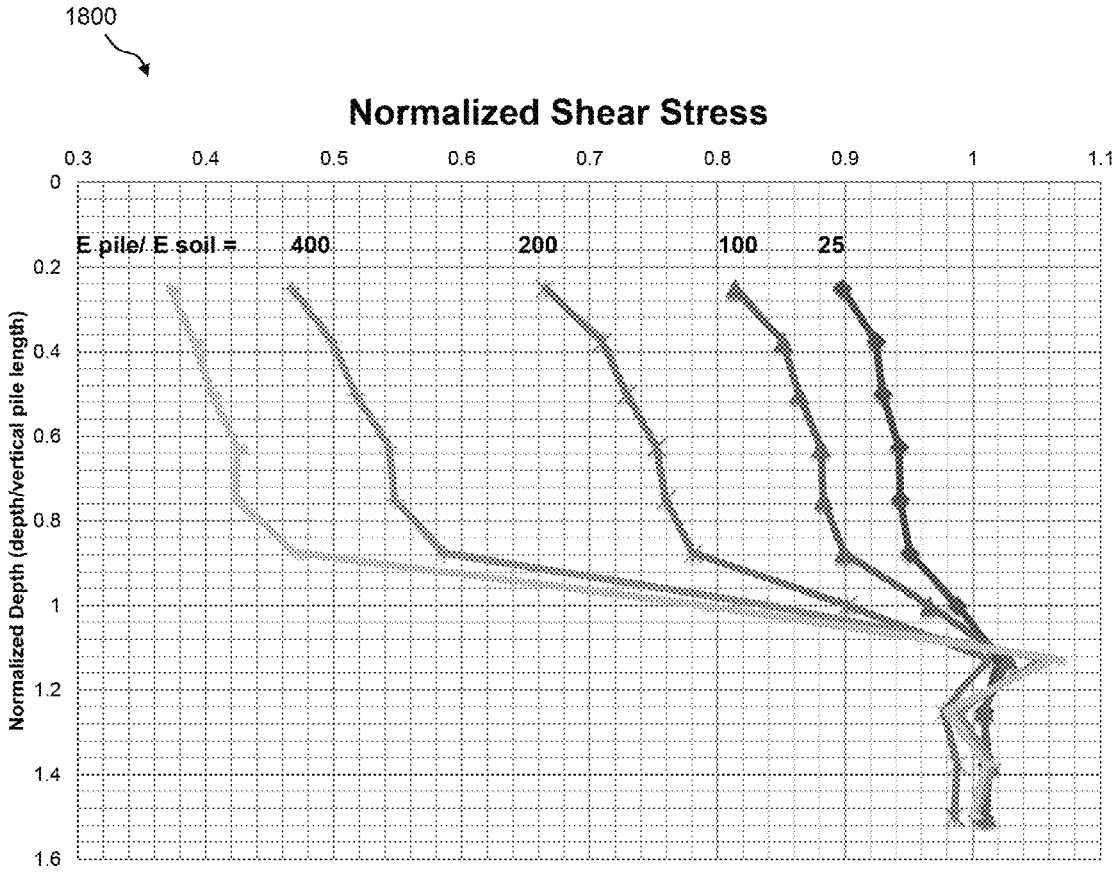
Figure 19:
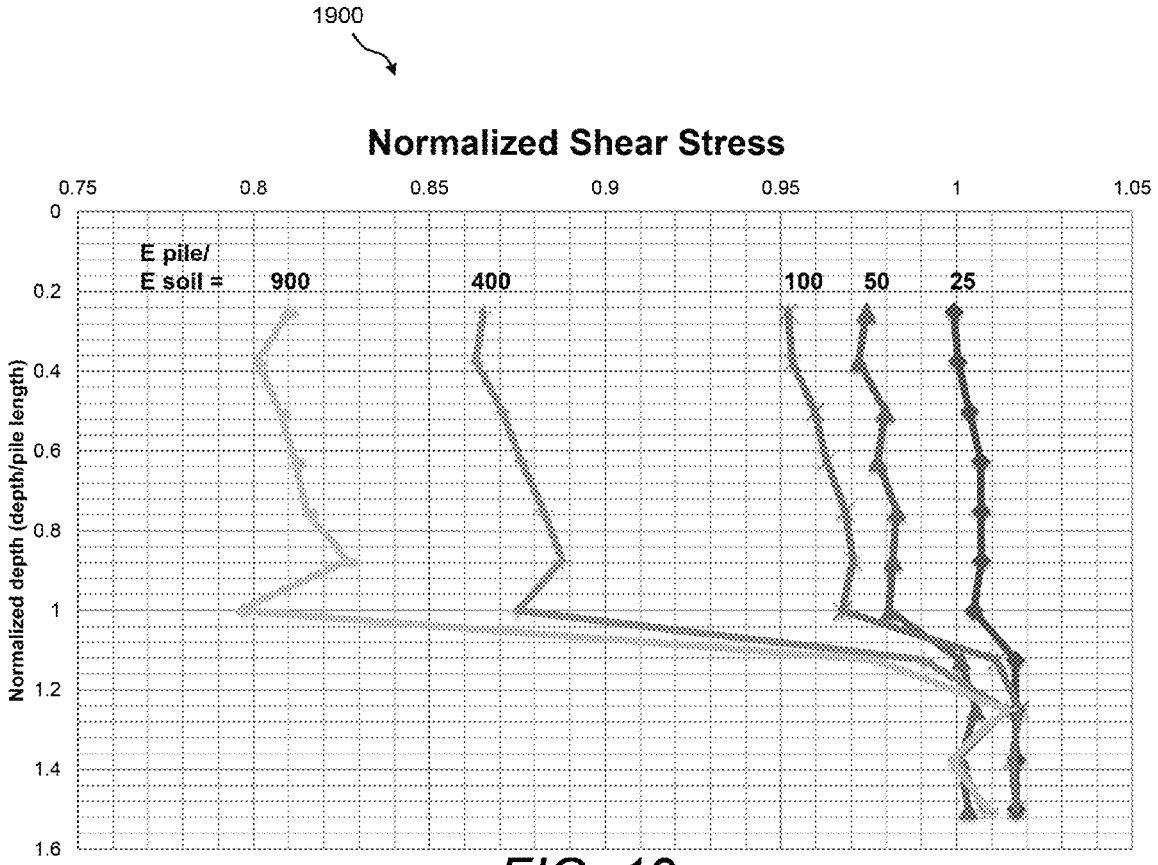

Having thus described the presently disclosed subject matter in general terms, reference will now be made to the accompanying Drawings, which are not necessarily drawn to scale, and wherein:

FIG. 1 and FIG. 2 illustrate a side view and top down view, respectively, of an example of a soil reinforcement system that includes angled reinforcement elements for absorbing earthquake-induced seismic shear stresses and forces in accordance with the present invention;

FIG. 3 illustrates a side view of one angled reinforcement element and showing more details thereof;

FIG. 4, FIG. 5, and FIG. 6 illustrate side views of a process of forming and installing an angled reinforcement element according to one embodiment of the invention, FIG. 7 illustrates a flow diagram of an example of a method of forming and installing the angled reinforcement element of FIG. 4, FIG. 5, and FIG. 6;

FIG. 8 and FIG. 9 illustrate side views of a process of forming and installing an angled reinforcement element according to another embodiment of the invention;

FIG. 10 illustrates a flow diagram of an example of a method of forming and installing the angled reinforcement element of FIG. 8 and FIG. 9;

FIG. 11 and FIG. 12 illustrate side views of a process of forming and installing an angled reinforcement element according to yet another embodiment of the invention;

FIG. 13 illustrates a flow diagram of an example of a method of forming and installing the angled reinforcement element of FIG. 11 and FIG. 12;

FIG. 14 shows a schematic of the transfer of seismic shear forces to the angled reinforcement element and to the matrix soil around the angled reinforcement element in accordance with the present invention;

FIG. 15 shows a schematic of the load transfer mechanism provided by the present invention loaded by one shear force;

FIG. 16 shows a schematic of the propagation of the distribution of sinusoidal shear stresses applied within unreinforced soil mass at two time intervals for a simulated earthquake;

FIG. 17 shows a schematic of the load transfer mechanisms provided by the present invention loaded by two shear forces;

FIG. 18 shows a plot of the normalized shear stress vs. normalized depth for an array of angled reinforcement elements of the present invention; and FIG. 19 shows a plot of the normalized shear stress vs. normalized depth for an array of conventional prior art vertical elements.

DETAILED DESCRIPTION

The presently disclosed subject matter will now be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a soil reinforcement system including angled soil reinforcement elements to resist seismic shear forces and methods of making same. In particular, the invention is directed to a soil reinforcement system for and methods of installing angled reinforcement elements within the ground, wherein the angled reinforcement elements are designed to absorb and/or resist earthquake-induced seismic shear forces by transferring the applied shear forces into axial compressive and tensile forces within each of the angled reinforcement elements.

In one aspect, a soil reinforcement system and method is provided for the installation of angled reinforcement elements in soils subject to earthquake ground motions. A method consists of inserting an angled reinforcement element with a sufficient rigidity and area ratio into the soil profile such that the seismic shear stresses are transferred to the angled reinforcement element, thus reducing the potential for soil liquefaction. The angled reinforcement elements may be inserted by drilling, driving, or other means and may consist of metallic materials (e.g., steel, cast iron, aluminum,), non-metallic materials (e.g., concrete, grout, plastic, fiberglass), or combinations of materials (e.g., concrete filled fiberglass tube, plastic filled steel tube) that exhibit a stiffness modulus greater than that of the matrix soil.

The presently disclosed soil reinforcement system that includes angled reinforcement elements provides certain advantages over conventional prior art reinforcing methods, such as vertical reinforcing methods. Namely, the presently disclosed soil reinforcement system provides a more efficient mechanism for resisting shear forces than, for example, vertical reinforcing methods, by transferring applied shear forces in the angled reinforcement element into axial compressive and tensile forces that act along the axis of the angled reinforcement element.

Generally, the presently disclosed soil reinforcement system employs angled reinforcement elements that are inserted into the ground to absorb and/or resist seismic shear forces. Each of the angled reinforcement elements has a stiffness modulus that is greater than the stiffness modulus of the soil that it reinforces. During seismic shaking, each of the angled reinforcement elements acts in compression or tension to resist the ground motions. This causes a reduction in the shear stress demand applied to the matrix soil, which, in turn, reduces soil liquefaction potential.

FIG. 1 and FIG. 2 illustrate a side view and top down view, respectively, of an example of a soil reinforcement system 100 that includes an arrangement of angled reinforcement elements 110 for absorbing earthquake-induced seismic shear forces. The angled reinforcement elements 110 of soil reinforcement system 100 are installed across an area of matrix soil 150, which is the ground. Matrix soil 150 can include, for example, any type or types of soil, any type or types of rock, or any combinations of any type or types of soil and rock and in any proportions.

The angled reinforcement elements 110 are formed, for example, of metallic materials (e.g., steel, cast iron, aluminum,), non-metallic materials (e.g., concrete, grout, plastic, fiberglass, wood), or combinations of materials (e.g., concrete filled fiberglass tube, plastic filled steel tube) that exhibit a stiffness modulus greater than that of the matrix soil 150. The angled reinforcement elements 110 may be inserted by drilling, driving, or other means. Examples of angled reinforcement elements 110 are shown and described with reference to FIG. 3 through FIG. 18.

The soil reinforcement system 100 can include any number and arrangement of angled reinforcement elements 110 as long as the goal of absorbing and/or resisting earthquake-induced seismic shear forces for reducing soil liquefaction potential is substantially achieved. Namely, the angled reinforcement elements 110 can be arranged in any random or non-random pattern that is useful for absorbing and/or resisting earthquake-induced seismic shear forces.

Wherein conventional prior art vertical (non-angled) elements, such as driven pilings or drilled shafts, may be used to reduce seismic shearing stresses within the matrix soil, a limitation of the use of vertical elements is that if they are sufficiently slender, they resist a significant portion of the applied shear stresses by bending, a mechanism that results in less reduction of shear stresses within the reinforced matrix soil. This mechanism thus may significantly reduce the ability of the vertical elements to reduce soil liquefaction potential. It is the intent of the presently disclosed soil reinforcement system 100, which includes angled reinforcement elements 110, to overcome this limitation.

In one example, the soil reinforcement system 100 includes an array or grid of angled reinforcement elements 110 installed in matrix soil 150. The array or grid of angled reinforcement elements 110 can include any number of rows and columns, wherein each row and column can include any number of angled reinforcement elements 110. In the example shown in FIG. 1 and FIG. 2, soil reinforcement system 100 includes a 25×25 array of angled reinforcement elements 110 installed in matrix soil 150, wherein FIG. 1 shows one row (or line) of the 25×25 array of angled reinforcement elements 110. The presence of any arrangement of angled reinforcement elements 110 in the matrix soil 150 creates a reinforced zone 115 in the matrix soil 150. Although not shown in FIG. 1, a second array of reinforcement elements that is orthogonal or transverse to the first array may also be installed to resist earthquake movement from other directions.

One row of the angled reinforcement elements 110 is installed to reinforce a zone of width w1 generally from the proximal end of the first angled reinforcement element 110 to the proximal end of the last angled reinforcement element 110, as shown in FIG. 1 and FIG. 2. Additionally, one column of the angled reinforcement elements 110 is installed to reinforce a zone of width w2 generally from the proximal end of the first angled reinforcement element 110 to the proximal end of the last angled reinforcement element 110, as shown in FIG. 2.

The rows of angled reinforcement elements 110 are installed at a spacing s1. Spacing s1 can be constant or variable along the rows of angled reinforcement elements 110. The columns of angled reinforcement elements 110 are installed at a spacing s2. Spacing s2 can be constant or variable along the columns of angled reinforcement elements 110. Spacing s1 and spacing s2 can be the same or different. In one example, both the spacing s1 and spacing s2 are a substantially constant spacing of about 10 feet.

Additionally, each of the angled reinforcement elements 110 has a length $L_{ARE}$ (see FIG. 3) and a diameter $D_{ARE}$ (see FIG. 3). Further, the angled reinforcement elements 110 are installed at an angle θ with respect to a surface 155 of the matrix soil 150 and to a depth d1 into the matrix soil 150. For a certain length $L_{ARE}$, the depth d1 of the angled reinforcement elements 110 and the lateral extent Lx of the angled reinforcing elements will depend on the angle θ.

The depth d1 of the array of angled reinforcement elements 110 is selected based on the in-situ liquefaction susceptibility of the matrix soil 150 and the consequences of liquefaction at a given depth profile. The depth d1 of the angled reinforcement element 110 typically can be from about 10 feet to about 70 feet, or is about 40 feet in one example.

The spacing s1 and spacing s2 and the diameter $D_{ARE}$ of the angled reinforcement elements 110 are selected so that the transfer of the seismic shear stresses to the angled reinforcement elements 110 is sufficient to reduce the stresses in the soil in order to mitigate or reduce the triggering of liquefaction. The spacing s1 and spacing s2 of the angled reinforcement element 110 typically can be from about 4 feet to about 30 feet, or is about 10 feet in one example. The diameter $D_{ARE}$ of the angled reinforcement element 110 typically can be from about 2 inches to about 24 inches, or is about 12 inches in one example. The length $L_{ARE}$ of the angled reinforcement element 110 typically can be from about 15 feet to about 100 feet, or is about 57 feet in one example.

The angle θ of angled reinforcement elements 110 is selected based on both installation and load transfer efficiency criteria. The angle θ of the angled reinforcement element 110 typically can be from about 45 degrees to about 80 degrees, and is about 45 degrees in one example.

By way of example, FIG. 3 shows one angled reinforcement element 110. In this example, if the angle θ of the angled reinforcement element 110 is about 45 degrees, in order to provide a depth d1 of about 40 feet and a lateral extent Lx (for a single angled reinforcement element 110) of about 40 feet, then the length $L_{ARE}$ of the angled reinforcement element 110 must be about 56.6 feet. If the 25×25 array of angled reinforcement elements 110 shown in FIG. 2 is installed in matrix soil 150 according to FIG. 3 and if spacing s1 and spacing s2 are both about 10 feet, then the width w1 of the reinforced zone 115 is about 240 feet and the width w2 of the reinforced zone 115 is about 240 feet.

FIG. 4 through FIG. 13 show and describe three examples of angled reinforcement elements 110 and respective methods of forming the three examples of angled reinforcement elements 110. However, the presently disclosed angled reinforcement elements 110 are not limited to these three examples only.

In one embodiment and referring now to FIG. 4 and FIG. 5, the angled reinforcement element 110 may consist of concrete-filled or grout-filled shafts that are formed in the ground. For example, FIG. 4 shows a mandrel 410 that is driven or pushed into the matrix soil 150 to form an elongated hold or cavity (or shaft). The mandrel 410 is typically hollow (but typically with a removable closed end driving cap, for example, which can be valved or sacrificial) and forms a hollow channel or shaft in the matrix soil 150. Then, the mandrel 410 is filled with a flowable material 415. The flowable material 415 can be, for example, concrete or grout. Once the mandrel 410 is filled (or during filling), but before the flowable material 415 is cured to a hardened state, the mandrel 410 is extracted from the matrix soil 150, leaving behind an angled channel or column of, for example, concrete or grout in the matrix soil 150, as shown in FIG. 5. Namely, FIG. 5 shows the resulting angled reinforcement element 110 (minus the mandrel 410), which is formed of the cured flowable material 415. In another example, instead of using the hollow mandrel 410, an angled hole or cavity (or shaft) can be drilled in the matrix soil 150 using a hollow-flight or solid-flight auger and the angled hole is then filled with the flowable material 415. Optionally and referring now to FIG. 6, before the flowable material 415 is cured, steel reinforcing rods 420 may be installed in the flowable material 415. The presence of steel reinforcing rods 420 allows the resulting angled reinforcement element 110 to better resist both compressive and tensile loads.

FIG. 7 shows a flow diagram of an example of a method 700 of forming and installing the angled reinforcement element 110 that is shown and described with reference to FIG. 4, FIG. 5, and FIG. 6. Whereas method 700 describes a method of forming one angled reinforcement element 110, the soil reinforcement system 100 is formed by repeating method 700 for each of the multiple angled reinforcement elements 110 in the soil reinforcement system 100. Method 700 may include, but is not limited to, the following steps.

At a step 710, the flowable material from which the angled reinforcement element 110 is to be formed is selected and prepared. In one example and referring now to FIG. 4, the flowable material 415 can be, for example, concrete or grout. If concrete is selected, then the concrete is prepared. If grout is selected, then the grout is prepared.

At a step 715, at any desired angle θ, an elongated shaft is formed in the ground according to the desired element length $L_{ARE}$ and element diameter $D_{ARE}$. In one example and referring again to FIG. 4, the mandrel 410 is driven into the matrix soil 150 to form the elongated shaft. The size of the mandrel 410 depends on the desired element length $L_{ARE}$ and the desired element diameter $D_{ARE}$. In one example, the mandrel 410 is about 50 feet long, has a diameter of about 1 foot, and is driven into the matrix soil 150 at about a 45-degree angle. In another example, such as in cohesive soils, instead of using the mandrel 410, a hole is drilled in the matrix soil 150. In one example, the hole is about 50 feet long, has a diameter of about 1 foot, and is drilled into the matrix soil 150 at about a 45-degree angle.

At a step 720, the elongated shaft is filled with the flowable material selected in step 710. In one example, the mandrel 410 is filled with the flowable material 415, such as concrete or grout, and then the mandrel 410 is extracted from the matrix soil 150 (or the mandrel is extracted while the flowable material is filled), leaving behind a channel or column of concrete or grout in the matrix soil 150, as shown in FIG. 5. In another example (e.g., drilling), the hole is filled with the flowable material 415, such as concrete or grout, to form the angled channel or column of concrete or grout in the matrix soil 150.

At an optional step 725, reinforcing rods are installed in the elongated shaft. For example, before the flowable material 415 is cured, steel reinforcing rods 420 may be installed in the flowable material 415, as shown in FIG. 6.

In yet another embodiment and referring now to FIG. 8 and FIG. 9, the angled reinforcement element 110 may consist of a hollow tube 810 comprised of, for example, concrete, steel, aluminum, plastic, fiberglass, composite materials, or any combinations thereof. Optionally, the hollow tube exhibits properties that allow it to resist applied tensile loads. The hollow tube typically has a closed end (pointed or otherwise) on one end for driving. The hollow tube 810 is driven into the matrix soil 150 and then filled with a flowable material 815. Examples of flowable material 815 include, but are not limited to, concrete; grout; granular materials, such as gravel, aggregate, sand, recycled concrete, crushed glass, or other flowable materials; and any combinations thereof. Granular infill materials may be compacted in place using a compaction device or piling equipment 1115 shown in FIG. 11 to increase their density and the composite stiffness of the angled reinforcement element 110. Optionally, steel reinforcing rods, such as the steel reinforcing rods 420 shown in FIG. 6, may be installed in the flowable material 815. Additionally, flowable material 815 can include materials with high permeabilities that facilitate the drainage of excess pore water pressures during and after seismic events.

FIG. 10 shows a flow diagram of an example of a method 1000 of forming and installing the angled reinforcement element 110 that is shown and described with reference to FIG. 8 and FIG. 9. Whereas method 1000 describes a method of forming one angled reinforcement element 110, the soil reinforcement system 100 is formed by repeating method 1000 for each of the multiple angled reinforcement elements 110 in the soil reinforcement system 100. Method 1000 may include, but is not limited to, the following steps.

At a step 1010, the flowable material from which the angled reinforcement element 110 is to be formed is selected and prepared. Referring now to FIG. 8, the flowable material 815 can be, for example, concrete; grout; granular materials, such as gravel, aggregate, sand, recycled concrete, crushed glass, or other flowable materials; and any combinations thereof. If concrete or grout is selected, then the concrete or grout is prepared. If granular materials are selected, then the granular materials are prepared.

At a step 1015, an elongated shaft is formed in ground to any desired depth d1 and diameter $D_{ARE}$ and at any desired angle θ. In one example, a hole is drilled in the matrix soil 150. For example, a 1-foot diameter hole is drilled in the matrix soil 150 at about a 45-degree angle and to a depth d1 of about 40 feet. It is understood that this step may be optional if the hollow tube 810 can be driven in to the matrix soil 150 without the pilot shaft being needed.

At a step 1020, a hollow casing or tube is driven or pushed into the shaft in the matrix soil 150. For example and referring to FIG. 8 and FIG. 9, hollow tube 810 is driven or pushed into the shaft in the matrix soil 150. The hollow tube 810 can be formed, for example, of concrete, steel, aluminum, plastic, fiberglass, composite materials, or any combinations thereof.

At a step 1025, the elongated hollow casing or tube is filled with the flowable material selected in step 1010. In one example, the hollow tube 810 is filled with the flowable material 815, such as concrete; grout; granular materials, such as gravel, aggregate, sand, recycled concrete, crushed glass, or other flowable materials; and any combinations thereof, as shown in FIG. 8 and FIG. 9.

At an optional step 1030, reinforcing rods are installed in the hollow casing or tube. For example, before the flowable material 815 is cured, steel reinforcing rods 420 (see FIG. 6) may be installed in the flowable material 815.

While FIG. 4 through FIG. 10 describe examples of angled reinforcement elements 110 that are formed directly within the matrix soil 150, FIG. 11, FIG. 12, and FIG. 13 describe an example of an angled reinforcement element 110 that is formed separately outside of the matrix soil 150 and then installed into the matrix soil 150.

In another embodiment and referring now to FIG. 11 and FIG. 12, the angled reinforcement element 110 may consist of an elongated solid and rigid element that can be driven or pushed into the matrix soil 150 using, for example, compaction device or piling equipment 1115. In particular, the material that is used to form the solid and rigid angled reinforcement element 110 has a material stiffness value greater than that of the matrix soil 150. Examples of such materials include, but are not limited to, steel, concrete, fiberglass, wood piling, plastic, composite materials, and any combinations thereof. The reinforcement element 110 embodiment as shown in FIG. 12 is circular in cross-section (such as a pointed cylinder), but it is understood that a variety of cross-sections may be used such as, for example, square, rectangle, T-shaped, X-shaped, or cross-shaped.

FIG. 13 shows a flow diagram of an example of a method 1300 of forming and installing the angled reinforcement element 110 that is shown and described with reference to FIG. 11 and FIG. 12. Whereas method 1300 describes a method of forming one angled reinforcement element 110, the soil reinforcement system 100 is formed by repeating method 1300 for each of the multiple angled reinforcement elements 110 in the soil reinforcement system 100. Method 1300 may include, but is not limited to, the following steps.

At a step 1310, an elongated, solid, rigid element is formed according to the desired length $L_{ARE}$ and diameter $D_{ARE}$ of the angled reinforcement element 110. For example, the elongated, solid, rigid element can be formed of steel, concrete, fiberglass, wood piling, plastic, composite materials, and any combinations thereof to create an angled reinforcement element 110. In one example, the resulting elongated, solid, rigid angled reinforcement element 110 is about 50 feet long and has a diameter of about 1 foot.

At a step 1315, at any desired angle θ, the elongated, solid, rigid element is driven or pushed into the matrix soil 150. For example, the resulting elongated, solid, rigid angled reinforcement element 110 is driven or pushed into the matrix soil 150 using, for example, compaction device or piling equipment 115 shown in FIG. 11.

During seismic events, shear stresses are transmitted from bedrock upwards through the soil profile. When seismic shear stresses are applied to saturated loose deposits of sand, silt, and low plasticity clay, the soil particles have a tendency to contract (move towards each other) and the water that exists in the pore spaces becomes pressurized. As the pore water pressure increases, the effective stress in the soil decreases resulting in reduction of soil shear strength. With time, the elevated pore water pressure causes the pore water to vent, which results in seismically-induced settlement. It is the intent of the presently disclosed soil reinforcement system 100 to reduce the magnitude of the peak shear forces applied to the soil at a given elevation within the reinforced zone 115 (see FIG. 1 and FIG. 2) by transferring these shear forces to the angled reinforcement elements 110.

Shear forces applied to heterogeneous materials de-aggregate into component shear forces where the magnitudes of the component shear forces depend on the relative stiffnesses and areas of the heterogeneous components. Referring to FIG. 14, the shear forces $V_{EQ}$ that propagate upward through the soil profile during seismic events may be resisted in part by the shear force $V_S$ applied to the matrix soil 150 between the angled reinforcement elements 110 and the shear force $V_P$ applied to the angled reinforcement elements 110. The sum of shear force $V_S$ and shear force $V_P$ must equal shear forces $V_{EQ}$ to satisfy equilibrium. The magnitudes of shear force $V_S$ and shear force $V_P$ depend on the component area encompassed by shear force Vs and the component area encompassed by shear force Vp and also depends on the relative stiffness of the components. The higher the percentage of area covered by the angled reinforcement element 110 and the higher the stiffness of the angled reinforcement element 110, the greater the magnitude of shear force $V_P$ relative to shear force $V_S$. It is the intent of the present invention to decrease the magnitude of shear force $V_S$ to a level that is insufficient to cause the matrix soil to liquefy.

The shear force $V_P$ that is applied to the angled reinforcement element 110 is in turn resisted by the development of axial compressive or tensile stresses within the element and by transverse shear forces within the element. Referring to FIG. 15, the shear force $V_P$ that is applied to the angled reinforcement element 110 is made up of vector components transverse to, and along the axis of element 110. Using geometry, the magnitude of axial force $P_P$ is computed as the product of applied shear force $V_P$ and the sine of the angle α, which is the angle of inclination. Thus, the smaller the angle α, the greater the value of axial force $P_P$ required to achieve equilibrium with the applied load of shear force $V_P$. The axial force $P_P$ is, in turn, resisted by the sum of the unit tractile forces $F_S$ that develop along the element shaft. Examples of tractile forces $F_S$ are tractile cohesion and friction resistance. Thus, applied shear force $V_P$ results in axial force $P_P$, which is resisted by the sum of the tractile forces $F_S$ acting along its shaft. It is the intent of the present invention to distribute applied shear loads along the shaft of the angled reinforcement element 110.

The description above is applicable for a single shear force to be applied to the angled reinforcement element 110. However, earthquakes cause shear stress to propagate throughout the soil profile resulting in a spectrum of shear stress applied at various elevations at various times. Referring to FIG. 16, a plot 1600 is shown of the sinusoidal shear stress distributions that may occur within the ground at two different discrete times (e.g., time A and time B) during a simulated earthquake. In accordance with the simulated input motion, the shear stress distribution has a sinusoidal shape. At time A, peak shear stresses occur at depths with peak values occurring at depths indicated by depths 1, 2, and 3. At depths 1 and 3, the peak shear stresses Veq1 and Veq3 are applied in the left direction. At depth 2, the peak shear stress Veq2 is applied in the right direction. At depths midway between depths 1 and 2 and midway between depths 2 and 3, the shear stress is zero. At time B, the shear wave has moved up in the soil profile such that no shear stresses are experienced at depths 1, 2, and 3. Rather, peak shear stresses are experienced at the midway depths between depths 1 and 2 and between depths 2 and 3. FIG. 16 shows that the seismic stresses applied to the reinforced depth H of a given soil profile change with time and may consist of multiple stresses resulting in either compression or tension within the angled reinforcement element 110.

A schematic representation of the application of two shear forces, each acting in opposite directions, is shown in FIG. 17. Namely, FIG. 17 illustrates the case of a rightward-acting shear force $V_{P1}$ applied to the upper portion of the angled reinforcement element 110 and a leftward-acting shear force $V_{P2}$ applied to the lower portion of the angled reinforcement element 110. Shear force is the product of shear stress applied over a tributary area. In this case, the downwardly angled compressive force $P_{P1}$ is resisted by the upwardly angled compressive force $P_{P2}$ and the tractile forces represented by the sum of tractile forces $F_{S1}$ that acts to resist $P_{P1}$ are negated by the tractile forces represented by the sum of tractile forces $F_{S2}$ acting to resist the upwardly angled compressive force $P_{P2}$. The net result of the load transfer mechanisms depicted in FIG. 17 are that the angled reinforcement element 110 internally resists the applied shear forces that act simultaneously but in two different directions on the soil profile. It is the intent of the presently disclosed soil reinforcement system 100 to capture these applied counteracting loads to reduce the potential for matrix soil liquefaction.

There are unlimited combinations of forces applied to the angled reinforcement element 110 with respect to time during an applied seismic event. Mathematical solutions can be achieved for many combinations, however, using computer numerical simulations. It is the intent of the presently disclosed soil reinforcement system 100 to capture many of these counteracting modes of applied forces.

The angled reinforcement elements 110 must exhibit a stiffness modulus greater than the matrix soil that they are reinforcing. Elements with a high interface friction coefficient exhibit improved functionality compared to those with low interface friction coefficients because of their ability to transmit applied shear forces $V_P$ into the angled reinforcement elements 110 and then in turn transmit these loads out of the angled reinforcement elements 110 through the sum of tractile forces $F_S$ transferred from the angled reinforcement elements 110 to the soil.

Referring again to FIG. 1 and FIG. 2, which shows the angled reinforcement elements 110 arranged in an array or grid pattern, if the angled reinforcement elements 110 are designed to resist compressive forces only, then a second array or grid of angled reinforcement elements 110 that are angled 180 degrees in plan view from the first array or grid is required. Further, to resist seismic forces that may occur orthogonal to the reinforced zone 115 shown in FIG. 1 and FIG. 2, an array or grid of angled reinforcement elements 110 is required in the transverse direction to that shown in FIG. 1 and FIG. 2, wherein the transverse direction may be perpendicular or not perpendicular to the first array or grid pattern.

EXAMPLE

A numerical analysis was performed to simulate the effects of applied earthquakes to the array or grid of angled reinforcement elements 110 shown in FIG. 1 and FIG. 2. The numerical analysis consisted of a two-dimensional plane strain model created using the software SAP 2000. The model included the following features: (a) the matrix soil 150 and angled reinforcement element 110 respond linearly; (b) perfect strain compatibility is developed at the junction in between the angled reinforcement elements 110 and the grid nodes; (c) vertical, horizontal, and rotational degrees of freedom of nodes along the left and right lateral boundaries of the finite element mesh shown in FIG. 1 displace equally; and (d) the Corralitos station acceleration time history recorded during the Loma Prieta earthquake, which has a peak ground acceleration of 0.48 g.

The angled reinforcement elements 110 were modeled as one-foot diameter frame elements as available in the SAP program. The frame elements develop moments, shear, and axial forces when loaded. The modulus of elasticity for the piles was varied during the investigation. Energy dissipation for the elastic model is handled in SAP 2000 through Rayleigh damping. An iterative procedure was used to introduce a damping ratio of 5% for the first and second modes of vibration. The model included a built-in algorithm which extrapolates damping for higher modes. A check of the damping coefficients was made by comparing: a) the fundamental period of vibration (T) obtained from SAP 2000 to b) that calculated using closed form equations.

The results of the numerical studies for the angled reinforcement elements 110 are shown in FIG. 18. Namely, FIG. 18 shows a plot 1800 of the normalized shear stress vs. normalized depth for angled reinforcement elements 110 on a grid spacing of 10 ft×10 ft. The results are shown in terms of the normalized shear stresses computed at points along a vertical section through the center of the finite element mesh shown in FIG. 1 for a given soil elastic modulus value, $E_{soil}$, where the normalized shear stress is defined as the maximum shear stress in the matrix soil computed by analyses containing inclined elements normalized by the maximum shear stress in the matrix soil computed by analyses that do not contain inclined elements.

Lower values of normalized shear stress indicate greater effectiveness of the angled reinforcement elements 110 in resisting applied shear stresses and forces. FIG. 18 shows plots of the normalized shear stress vs. normalized depth for angled reinforcement elements 110 for a grid spacing of angled reinforcement elements 110 that are 10 feet on-center for ground spacing. Normalized depth is the ratio of the depth from the ground surface in the model to the depth of the reinforced zone 115 shown in FIG. 1 and FIG. 2. FIG. 18 shows that normalized shear stresses computed using the model range from 0.37 to 0.95 within the upper 90 percent of the reinforced soil profile. Lower values of normalized shear are achieved for higher $E_{pile}/E_{soil}$ ratios. This means that the stiffer the angled reinforcement element 110 is relative to the soil, the more effective it is in reducing the shear stresses and forces applied to the matrix soil 150.

By contrast, FIG. 19 shows the results an equivalent set of numerical analyses applied to an array of conventional prior art vertical (non-angled) elements (not shown); namely, elements installed at angle θ=about 90 degrees. The vertical elements are also spaced in an array 10 feet on-center for ground spacing. Namely, FIG. 19 shows a plot 1900 of the normalized shear stress vs. normalized depth for vertical elements on a grid spacing of 10 ft×10 ft. FIG. 19 shows that the vertical elements achieve normalized stress ratios ranging from approximately 0.8 to 1.0 over the upper 90 percent of the soil profile. The higher normalized stress ratios relative to those shown in FIG. 18 indicate less effectiveness at resisting applied shear stresses.

Comparing the results shown in plot 1800 of FIG. 18 to those shown in plot 1900 of FIG. 19 for an $E_{pile}$ to $E_{soil}$ ratio of 400 at a normalized depth of 0.5, a normalized stress ratio of 0.52 is achieved for the angled reinforcement elements 110 and a normalized stress ratio of 0.87 is achieved for the conventional vertical elements. This means that the angled reinforcement elements 110 reduce about 70% more shear force than resisted by the conventional prior art vertical elements at the same stiffness and same spacing. These results demonstrate the efficiency of the presently disclosed soil reinforcement system 100 that includes the angled reinforcement elements 110.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A method of installing an array of non-vertical soil reinforcement elements to absorb seismic shear stresses in a soil matrix, comprising inserting an array of non-vertical soil reinforcement elements into a soil matrix at a determined angle and to a determined depth, wherein each of the soil reinforcement elements of the array of non-vertical soil reinforcement elements comprises a material that exhibits a stiffness modulus greater than the stiffness modulus of the soil matrix and wherein seismic shear stresses imparted from seismic activity are absorbed by the array of non-vertical soil reinforcement elements, thus reducing a potential for soil liquefaction, wherein the soil reinforcement elements are spaced from each other such that none of the non-vertical soil reinforcement elements within the array are in direct contact with another non-vertical soil reinforcement element within the array.

2. The method of claim 1, wherein the soil reinforcement elements are inserted in the soil matrix by drilling means.

3. The method of claim 1, wherein the non-vertical soil reinforcement elements are inserted in the soil matrix by driving means.

4. The method of claim 1, wherein the non-vertical soil reinforcement elements within the array comprise metallic material.

5. The method of claim 1, wherein the non-vertical soil reinforcement elements within the array comprise non-metallic material.

6. The method of claim 1, wherein the non-vertical soil reinforcement elements within the array comprise a combination of metallic and non-metallic materials.

7. The method of claim 1, wherein the determined depth is selected based on the in-situ liquefaction susceptibility of the matrix soil.

8. The method of claim 1, wherein the spacing and diameter of the array of non-vertical soil reinforcement elements is determined such that the transfer of the seismic shear stresses to the array of non-vertical soil reinforcement elements is sufficient to reduce shear strains in the soil to reduce the triggering of liquefaction.

9. The method of claim 1, wherein the angle of inclination is a predetermined angle based on desired installation and load transfer efficiency criteria.

10. The method of claim 1, wherein the non-vertical soil reinforcement elements comprise cast-in-place shafts that are formed in the soil matrix.

11. The method of claim 10, wherein the shafts are filled with one or more of concrete and grout.

12. The method of claim 11, wherein the non-vertical soil reinforcement elements are installed using a mandrel driven or pushed into the ground and filled with the one or more of concrete and grout, and then the mandrel is extracted.

13. The method of claim 11, wherein the method further comprises forming an angled drilled hole in the soil matrix and filling the angled hole with the one or more of concrete and grout.

14. The method of claim 11, wherein reinforcing steel is added to the one or more of concrete and grout shafts prior to curing.

15. The method of claim 1, wherein the non-vertical soil reinforcement elements are installed in the soil matrix by piling equipment and are driven or pushed into the soil matrix and are filled with an in-fill after driving.

16. The method of claim 1, wherein the non-vertical soil reinforcement elements are hollow and are filled with an in-fill material after installation.

17. The method of claim 16, wherein the in-fill material comprises one or more of concrete, grout, gravel, aggregate, sand, recycled concrete, crushed glass, and other flowable or pumpable material.

18. The method of claim 16, wherein the in-fill material is compacted in place using a compaction device.

19. The method of claim 1, wherein the non-vertical soil reinforcement elements comprise a permeable material that facilitates drainage of excess pore water pressures during and after seismic events.

20. The method of claim 1, wherein the array of non-vertical soil reinforcement elements are installed on a grid pattern.

21. The method of claim 20, further comprising a second grid pattern of two or more non-vertical soil reinforcement elements angled 180 degrees from the first grid pattern of the array of non-vertical soil reinforcement elements.

22. The method of claim 20, further comprising a second grid pattern of two or more non-vertical soil reinforcement elements installed in a transverse direction relative to a direction of the first grid pattern of the array of non-vertical soil reinforcement elements.

23. The method of claim 22, wherein the transverse direction is perpendicular to the first grid pattern.

24. The method of claim 22, wherein the transverse direction is not perpendicular to the first grid pattern.

25. An array of non-vertical soil reinforcement elements for absorbing seismic shear stresses in a soil matrix, the array of non-vertical soil reinforcement elements installed in a soil matrix each at a determined angle relative to the soil matrix and to a determined depth in the soil matrix, the array of soil reinforcement elements each comprising a material that exhibits a stiffness modulus greater than the stiffness modulus of the soil matrix wherein seismic shear stresses are absorbed by the array of non-vertical soil reinforcement elements to reduce potential for soil liquefaction, wherein each of the non-vertical soil reinforcement elements are spaced from each other such that none of the non-vertical soil reinforcement elements are in direct contact with another non-vertical soil reinforcement element within the array, and wherein spacing between each non-vertical soil reinforcement element of the array is about four feet to about thirty feet.

26. A system for installing an array of non-vertical soil reinforcement elements to absorb seismic shear stresses, comprising:

a) an array of non-vertical soil reinforcement elements; and b) a device for installing the array of non-vertical soil reinforcement elements into a soil matrix at a determined angle and to a determined depth;

wherein each non-vertical soil reinforcement elements of the array of non-vertical soil reinforcement elements comprise a material that exhibits a stiffness modulus greater than the stiffness modulus of the soil matrix wherein seismic shear stresses in the soil matrix imparted from seismic activity are absorbed by the array of non-vertical soil reinforcement element to reduce potential for soil liquefaction, wherein each of the non-vertical soil reinforcement elements are spaced from each other such that none of the non-vertical soil reinforcement elements are in direct contact with another non-vertical soil reinforcement element within the array, and wherein spacing between each non-vertical soil reinforcement element of the array is about four feet to about thirty feet.

27. The system of claim 26 wherein the device for installing the array of non-vertical soil reinforcement elements into the soil matrix comprises a piling device for driving or pushing each of the non-vertical soil reinforcement elements into the soil matrix.

28. The system of claim 26 wherein the device for installing the array of non-vertical soil reinforcement elements into the soil matrix comprises a mandrel driven or pushed into the soil matrix, wherein the mandrel is filled with one or more of grout and concrete, and then the mandrel is extracted.

29. The system of claim 26 wherein the device for installing the array of non-vertical soil reinforcement elements into the soil matrix comprises a drilling device wherein the drilling device forms an angled drilled hole in the soil matrix and the hole is then filled with one or more of concrete and grout.

* * * * *